United States Patent [19]

Vessa

[11] Patent Number: 5,008,870

[45] Date of Patent: Apr. 16, 1991

[54] FIFO CLOCK

[76] Inventor: James R. Vessa, 8833 Bay Pointe Dr., Tampa, Fla. 33615

[21] Appl. No.: 212,471

[22] Filed: Jun. 28, 1988

[51] Int. Cl.[5] ..... G04C 17/00

[52] U.S. Cl. ..... 368/242; 368/239; 368/223; 368/241

[58] Field of Search ..... 368/239–242, 368/222–226, 228

[56] References Cited

U.S. PATENT DOCUMENTS

| | | | |
|---|---|---|---|
| 3,651,634 | 3/1972 | Cooper . | |
| 3,922,847 | 12/1975 | Culley et al. | 368/241 |
| 4,095,413 | 6/1978 | Reich | 368/241 |
| 4,198,629 | 4/1980 | Marion | 368/241 |
| 4,254,488 | 3/1981 | Ojima et al. . | |
| 4,255,806 | 3/1981 | Fahrenschon et al. . | |
| 4,274,154 | 6/1981 | Dostoomian et al. . | |
| 4,279,031 | 7/1981 | Dostoomian et al. . | |
| 4,310,909 | 1/1982 | Fujita | 368/240 |
| 4,407,587 | 10/1983 | Fujita | 368/240 |
| 4,702,615 | 10/1987 | Havel | 368/241 |

FOREIGN PATENT DOCUMENTS

| | | | |
|---|---|---|---|
| 2840547 | 3/1980 | Fed. Rep. of Germany | 368/240 |
| 2521753 | 8/1983 | France | 368/241 |

*Primary Examiner*—Bernard Roskoski

*Attorney, Agent, or Firm*—Gifford, Groh, Sprinkle, Patmore and Anderson

[57] ABSTRACT

An electronic timepiece having a display with a center position and twelve columns. Each of the columns having at least five display elements extending in a radial direction from the center position. The display elements of each of the twelve columns defining at least five concentric rows. One of the rows defining a five minute hand row and another row defining an hour row. The minutes are displayed along each radial column to represent time periods of from one to four minutes with the fifth being indicated by the five minute indicators.

16 Claims, 8 Drawing Sheets

7
EXTERNAL TRANSFORMER
COLUMN DRIVERS
ROW DRIVERS
8
DECODE LOGIC
COLUMN LATCHES
ROW LATCHES
9
4X8 FIFO REGISTER
4-BIT A/B SWITCH
COUNTER
COMPARATOR
REF WORDS
CONTROL LOGIC
TIME SET SWITCHES
10
11
REFERENCE OSCILLATOR
FREQUENCY SYNTHESIS
AC/DC & FILTERING
BATTERY & CHGING

D's
FIFO
C Q's
B'S
A'S
A/B
D'S
D'S
PE
CL
U/D
RS
IC
Q'S
A'S
B's
A>B
A=B
REF
REF
GEN
A1
A0
TIMESET
CL
EL
RS
CARRY
MSet/HSet
UP
DN
M>
M<
H>
H<
S
CPX
CP0
CS0
CS1
CM1
Q4
CH0
Q3
CP1
CP2
1Sec
CP3
CP7
CP4
CM0

FIFO CLOCK

BACKGROUND OF THE INVENTION

This invention relates to a digital clock with simulated continuous movement hands. Existing digital clocks with hands incorporate the use of a stepping motor to rotate a seconds hand which is mechanically geared to a minute hand and thence to an hour hand to display the time. This clock uses lighted fixed display elements which are switched with the passage of time.

SUMMARY OF THE INVENTION

The basic concept of this unique clock is that of a lighted display which indicates time in a somewhat conventional fashion of seconds, minute and hour "hands" (comprising LED's), which is simple to read and yet displays time to the nearest second with minimal display cost.

The clock is organized into five basic sections. The Display, the Display Driver, the Timekeeping Mechanism, the Timebase and the Power Supply.

The display comprises an array of 12 columns of LED's in 8 Rows. The columns are arranged in radial arms at 30° increments at 12, 1, 2, 3, . . . , and 11 o'clock as in a conventional analog clock. The 8 rows are allocated as follows:

Row 7: (Outermost) 5-Minute increments.
Row 6: 5-Second increments
Row 5: Even Hour increments
Row 4: Half-hour increments
Row 3: Shared 4-Minute or 4-Second increments
Row 2: Shared 3-Minute or 3-Second increments
Row 1: Shared 2-Minute or 2-Second increments
Row 0: Shared 1-Minute or 1-Second increments Row 4 and row 5 actually share the same radius distance from the center of the clock but with row 4 being 15° (½-hour) in advance of row 5.

The Timebase can comprise either a crystal controlled oscillator or a relatively stable RC oscillator phase-locked to the 60 Hz mains frequency (which is in turn referenced to WWV) with divide down and decoding circuitry as required to provide appropriate "phase clocks" to synchronize the Timekeeping Mechanism.

A unique feature of the Timekeeping Mechanism is its organization in the form of a FIFO (First In First Out) register in conjunction with time shared computing elements and appropriate control logic. This register is clocked through a 64-phase cycle 60 times a second. These 64-phase cycles are of three types, (i) a display refresh cycle, (ii) a time increment cycle and (iii) a time set cycle. A unique feature of the time set cycle is the ability to set the time back as well as forward as is the case in all other digital clocks.

The Display Driver uses the response mechanism of the eye to utilize time division multiplexing of the display elements to minimize circuit components. The display is organized as 12 columns of 8 rows. The Display Driver thus must store the address of the element(s) to be displayed, provide appropriate decoding to select the element within the display and then light the selected element.

In the event of loss of mains power the clock switches into a standby mode. The Power Supply utilizes a Ni-Cad battery to maintain the timebase in this mode. A unique feature of the supply is the changing of the function of the seconds set switch in this mode. Pressing the switch at this time enables the display for a short time.

This gives the ability to read the clock in the stand-by mode.

By virtue of its organization into registers time sharing an arithmetic unit the clock can easily be implemented in the form of a Microprocessor (μP) with a proprietary program code and appropriate Peripheral Interface Adapters (PIA's) or with Medium Scale Integrated (MSI) circuits. The use of the latter permits rapid realization low initial cost implementation of the concept with μP versions to follow.

DETAILED DESCRIPTION OF THE INVENTION

Figure 1:
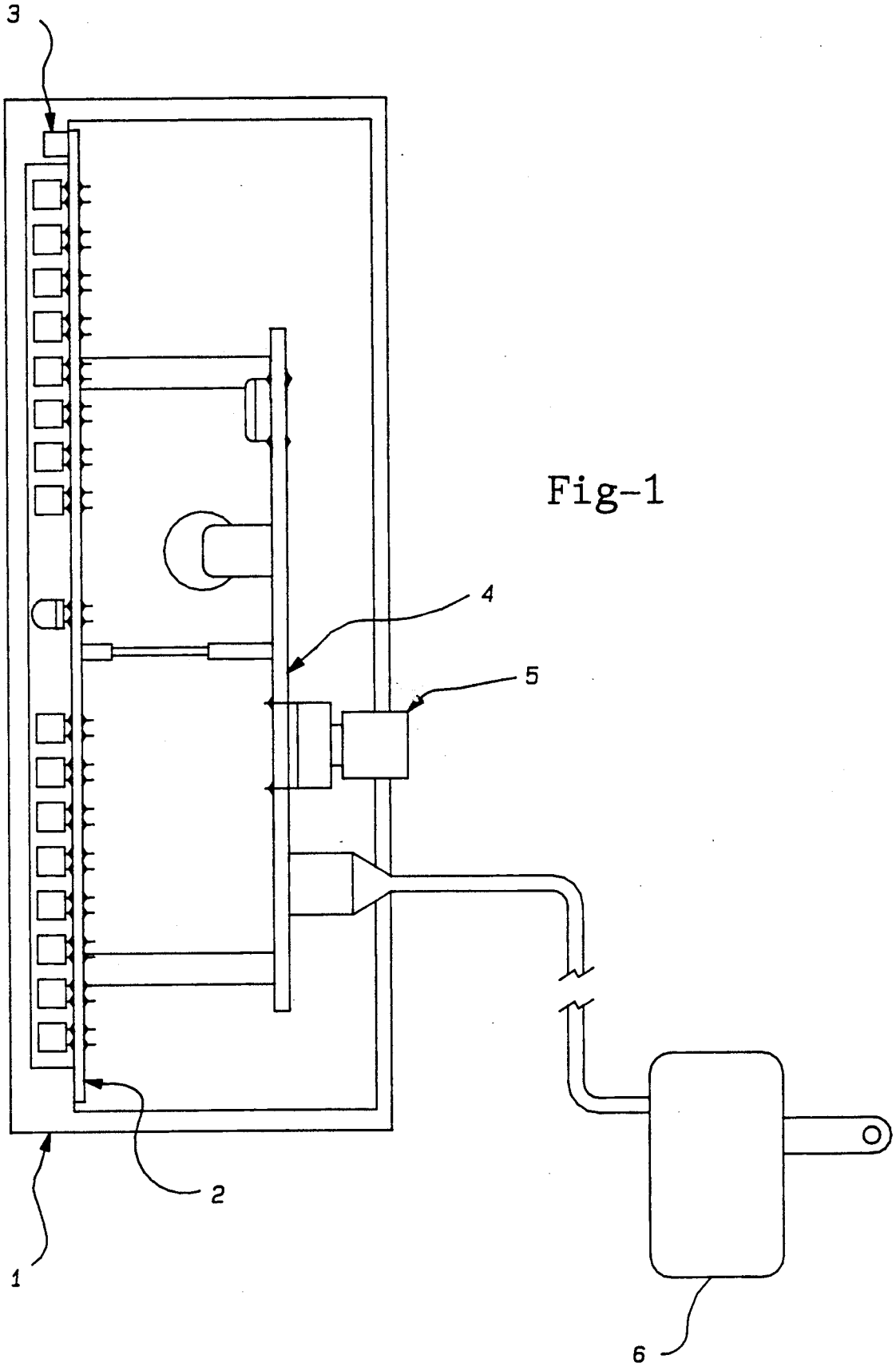
FIG. 1 is a cross-sectional view of the clock showing the physical relationship of the elements.

FIG. 1 shows how the clock is arranged within the smokey translucent case 1. The Display PCB Assembly 2 is supported on bosses 3 molded inside the case. The Clock Mechanism PCB Assembly 4 is supported by the Display PCB Assembly and it supports the Switch PCB Assembly 5 which is exposed on the back of the clock. The clock is powered by an external mains transformer 6. No markings are present upon the face of the clock. The lighted LED's shine through the translucent front face and time is recognized by the position of the "hands".

ORGANIZATION

Figure 2:
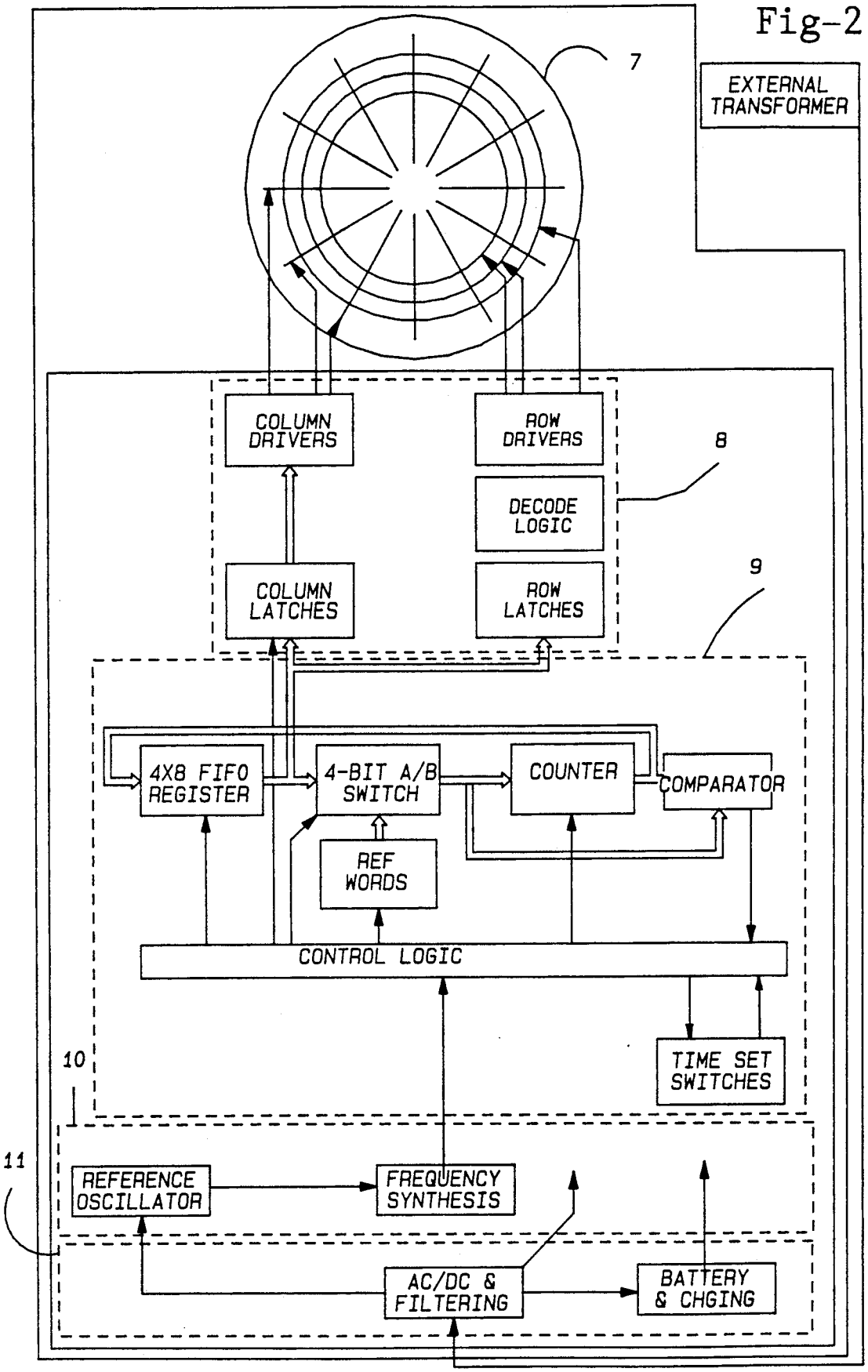
FIG. 2 is a block diagram of the clock dividing it into its functional sections.

FIG. 2 shows the organization of the clock into logical elements. The Display PCB Assembly 7 interfaces to the Timekeeping Circuits 9 via the the Display Interface Circuitry 8. The Timebase Circuitry 10 is derived from an accurate frequency reference which is ultimately divided down to provide a 1-second clock input to the Timekeeping Circuits but which also provides the various "phase clocks" to synchronize the system. The Power Supply section 11 ensures adequate distribution of clean power.

DISPLAY

FIG. 3 shows the development of the LED dial from a conventional clock face. FIG. 3*a* shows a conventional dial with the hands positioned at 3:37:46. The minute hand is at about 37 minutes. On the CICCI clock the time is displayed using 6 LED's (FIG. 3*b*). The "minute hand" comprises, at this time, a red LED 12 positioned on the outer ring at 7 o'clock and two green LED's 13 positioned on the inner two rings of the 8 o'clock radial, indicating 35 minutes+2 minutes=37 minutes past the hour. The hour hand is simulated by a red LED at the 3½ hour radial 14. The seconds hand is simulated by a green LED on the innermost ring of the 10 o'clock radial 15. Because this "hand" moves on 1-second increments is easily distiguished from the two "minute" LED's 13. A central red LED 16 acts as the pivital reference point. FIG. 3*c* gives a view of the appearance of the clock face.

Figure 3A:
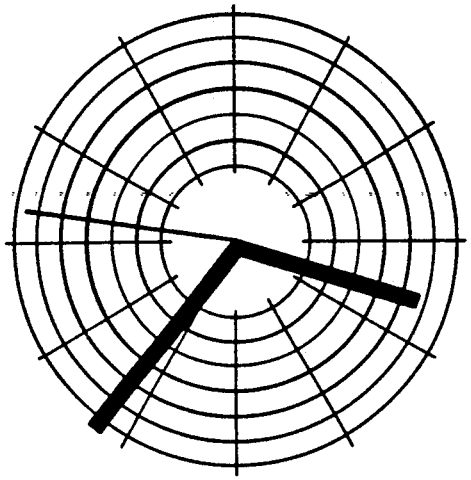
FIG. 3A–3D shows the development of the LED dial from a conventional clock face.
Figure 3B:
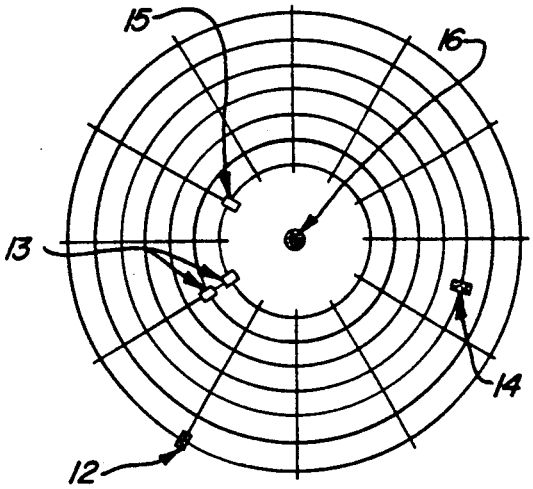
Figure 3C:
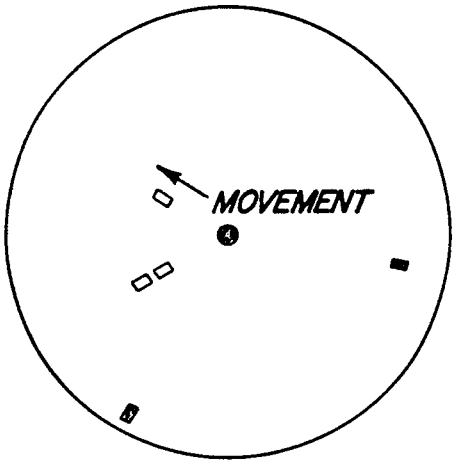
Figure 3D:
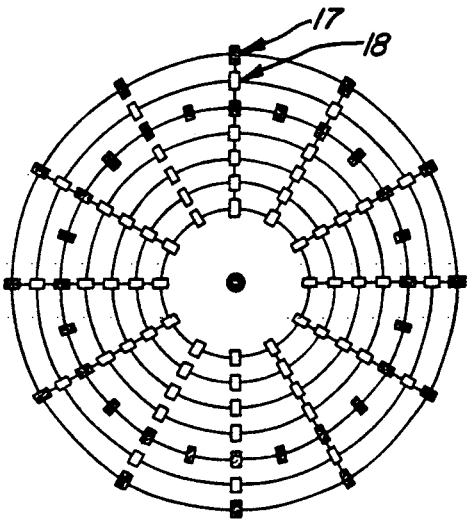

FIG. 3*d* shows the layout of the display face showing all the LED's. The display comprises an array of 36 red 17 and 60 green 18 LED's in 12 columns of 8 Rows plus a central red LED. The columns are arranged in radial arms at 30° increments at 1, 2, 3, . . ., 12 o'clock as in a conventional analog clock. The 8 rows are allocated as follows:

Row 7: (Outermost) 5-Minute increments. (Red).
Row 6:5-Second increments. (Green).
Row 5: Even Hour increments. (Red).
Row 4: Half-hour increments. (Red).
Row 3: Shared 4-Minute or 4-Second increments. (Green).
Row 2: Shared 3-Minute or 3-Second increments. (Green).
Row 1: Shared 2-Minute or 2-Second increments. (Green).
Row Ø: Shared 1-Minute or 1-Second increments. (Green).

Row 4 and row 5 actually share the same radius distance from the center of the clock but with row 4 being 15° (½-hour) after of row 5. The unique destinction between minutes and seconds is provided by:

(a) the frequency of the change.
(b) the pattern of the change. and
(c) optional color variations.

Figure 4:
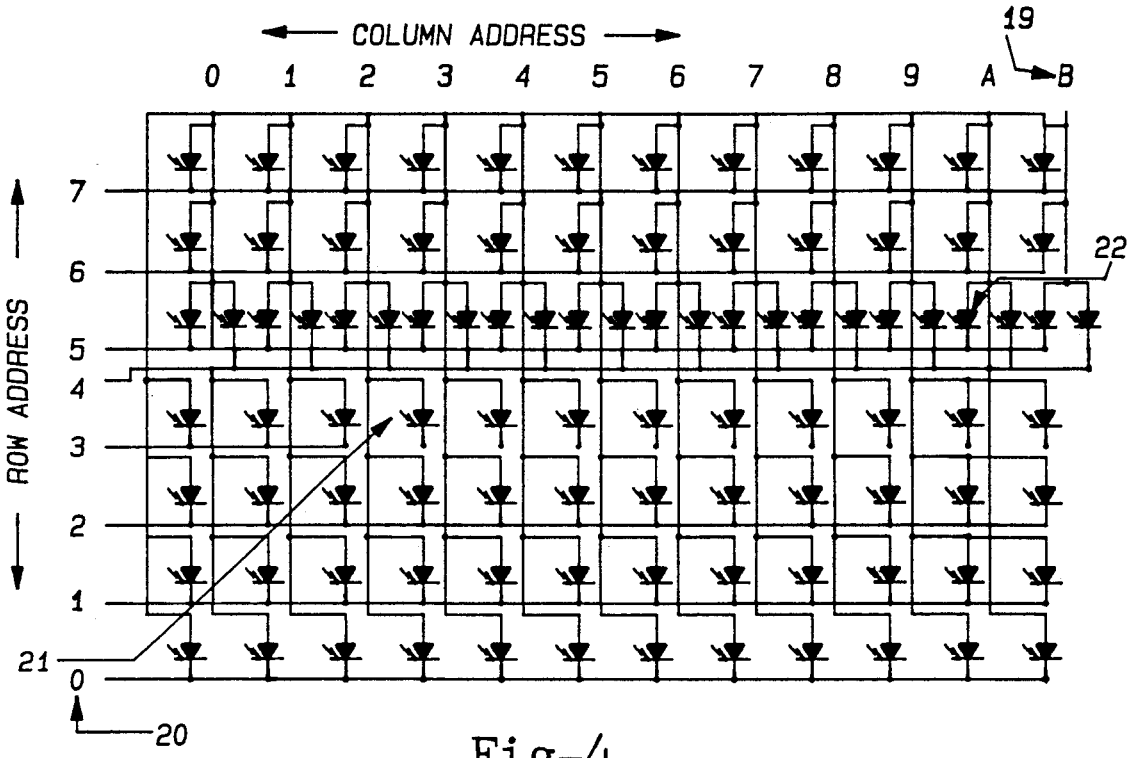
FIG. 4 is a diagram of the organization of the display.

FIG. 4 shows graphically the specific organization of the display. For this description, the columns and rows shall be defined using a two digit hexidecimal nomincla-ture system with the first digit 19 (Ø, 1, 2, 3, . . . , 9, A, B) (where "A" represents the decimal notation of 10 "B" represents that of 11) shall be the column address and the second digit 20 the row address (Ø, 1, 2, 3, 4, 5, 6, 7). This address is the logical wired address and not necessarily the physical location. The location on the clock dial shall be such that the "Ø" column position shall be 12 o'clock. The rows shall be defined as in the table above. Thus "13" shall be the fourth light out on the 1 o'clock radial electrically but shall be physically on the 2 o'clock radial 21, while "84" shall incicate the fifth light out from the center of the 8-o'clock radial 22. Using this system:

| Seconds | Location | Minutes | Location |
|---|---|---|---|
| 1 | 01 | 01 | 07 & 01 |
| 2 | 02 | 02 | 07 & 01 & 02 |
| 3 | 03 | 03 | 07 & 01 & 02 & 03 |
| 4 | 04 | 04 | 07 & 01 & 02 & 03 & 04 |
| 5 | 16 | 05 | 17 |
| 6 | 11 | 06 | 17 & 11 |
| 7 | 12 | 07 | 17 & 11 & 12 |
| et cetra. | | | |

The hours shall be:

| Hour | Location | |
|---|---|---|
| 12 | 05 | |
| ½ | 04 | |
| 1 | 15 | |
| 1½ | 14 | |
| 2 | 25 | |
| 2½ | 24 | et cetra. |

Note that in the case of the minutes display the displayed time is cumulative as contrasted to the seconds display in which only one LED is lighted at a time. Color selections can vary. With LED's (light emmiting diodes) the obvious choices are red, yellow (or amber) and green. In the particular implementation used in the initial model the color selections are green for rows Ø, 1,2,3 and 6 and red for 4,5 and 7. An alternative, but more costly display, could have two color LED's for rows Ø through 3. When displaying 1 through 4 seconds rows Ø through 3 would be lighed as green only. When displaying minutes they would be red only. A second's indication would have priority over the minute's, and as a result, the red would appear to walk through the green.

ALTERNATIVE DISPLAYS

An alternative display would be configured with the use of bands of electrolumnescent material of the desired colors with a superimposed negative liquid crystal shutter. When the selected shutter element was OFF, the entire face would appear black. When the element was ON, a clear window would be opened over the selected element, permitting the light from the electrolumnescent panel to be visible. The liquid crystal shutters would be organized as the LED's of FIG. 4.

A second variant of the electrolumnescent panel is the use of 97 separate segments organized in a fashion similar to the LED's described in FIG. 4.

GENERAL

A unique feature of the clock is the use of FIFO buffer register in conjunction with a single arithmetic counting system (counter) to markedly reduce parts count. The FIFO register is a 4-wide by 8-long shift register. In it are stored in order the current values of Ø–4 seconds, Ø-B 5's of seconds, Ø–4 minutes, Ø-B 5's of minutes, Ø–1 halves of hours, Ø-B hours, AM/PM and a spare register. In operation, the Ø–4 Seconds (Row) value is outputted from the FIFO register to the Row display latch and, via the A/B Switch, to the counter. Here a decision is made as to whether or not to increment the value presented. The result is then clocked into the input of the FIFO register which after clocking has the Ø–11 5's of Seconds (Column) value at its output and which is clocked to the Column display latch. The x-y matrix location of the required LED is now defined and can be turned ON. The same increment/no increment decision is made and again clocked to the FIFO input. This same proceedure is repeated for minutes and hours.

It is to be noted that the display is time division multiplexed, that is, first seconds are lighted, then extinguished, then minutes are lighted, then extinguished, then hours are lighted, then extinguished and then back to seconds. The eye however has the characteristic of rapid detection but slow loss of retention. The eye will see the short pulse but not forget it. If the repetition rate is greater than about 30 Hz it will appear to be on continuously.

TIME REFERENCE

Figure 5:
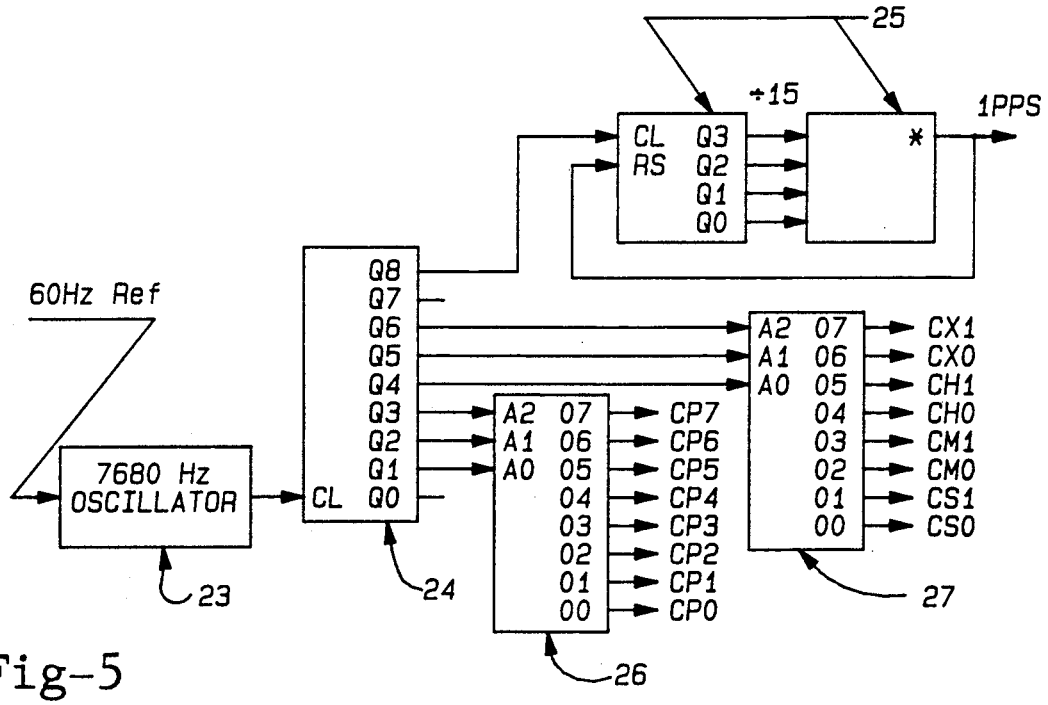
FIG. 5 is a block diagram of the frequency synthesizer.

FIG. 5 shows the time reference organization. In the initial implementation, an RC Oscilator 23 running at 7680 Hz (2 7 times 60 Hz), whose basic accuracy is adjusted to within 0.1% or 8 seconds per hour, provides the time reference. By means of feedback of the 1/(2 7)-output of the divider (Q6) to a phase detector 105 with associated loop filter 106 this oscillator is then phase-locked using conventional phase-locked techniques to the power line frequency of 60 Hz which is in turn locked to WWV and is accurate to within fractions of a cycle per year. By this means it is possible to provide a time piece of high accuracy at low cost. The basic accuracy of 8 seconds per hour is experienced only during periods of power outages, which, hopefully, are of short duration. (To be used in countries using a 50 Hz time base this must be 6400 Hz.) Note that 60 Hz is injected into the oscillator. The oscillator is tuned to free run within 0.1% of an exact harmonic of this 60 cycles, i.e. within ±7 Hz at 7680 Hz. This means that during a 1 cycle of the 60 Hz period (1/60 sec), the oscillator phase will drift less than 45° and the 60 cycle pulses will correct this to 0° each time they occur.

The 7680 Hz clock is then divided down by a binary divider of 2 9 24 and then by a divide-by-15 divider 25 to ultimately provide a 1 pps (pulse per second) clock. Outputs Q1, Q2 and Q3 are used as addresses of a 3-bit to 8-line decoder 26 to provide eight phase clocks (CPØ, CP1, . . . , CP7). CPØ is the FIFO clock of 480 Hz which clocks the FIFO through 64 complete cycles per second and CP1 through CP7 are other phase clocks for strobing and loading registers as will be described below. Q4, Q5 and Q6 are used as address of a second 3-bit to 4-line decoder 27 whose outputs are gate signals, CSØ, CS1, CMØ, CM1, CHØ, CH1, CXØCX1, whose function will be described below.

Figure 6:
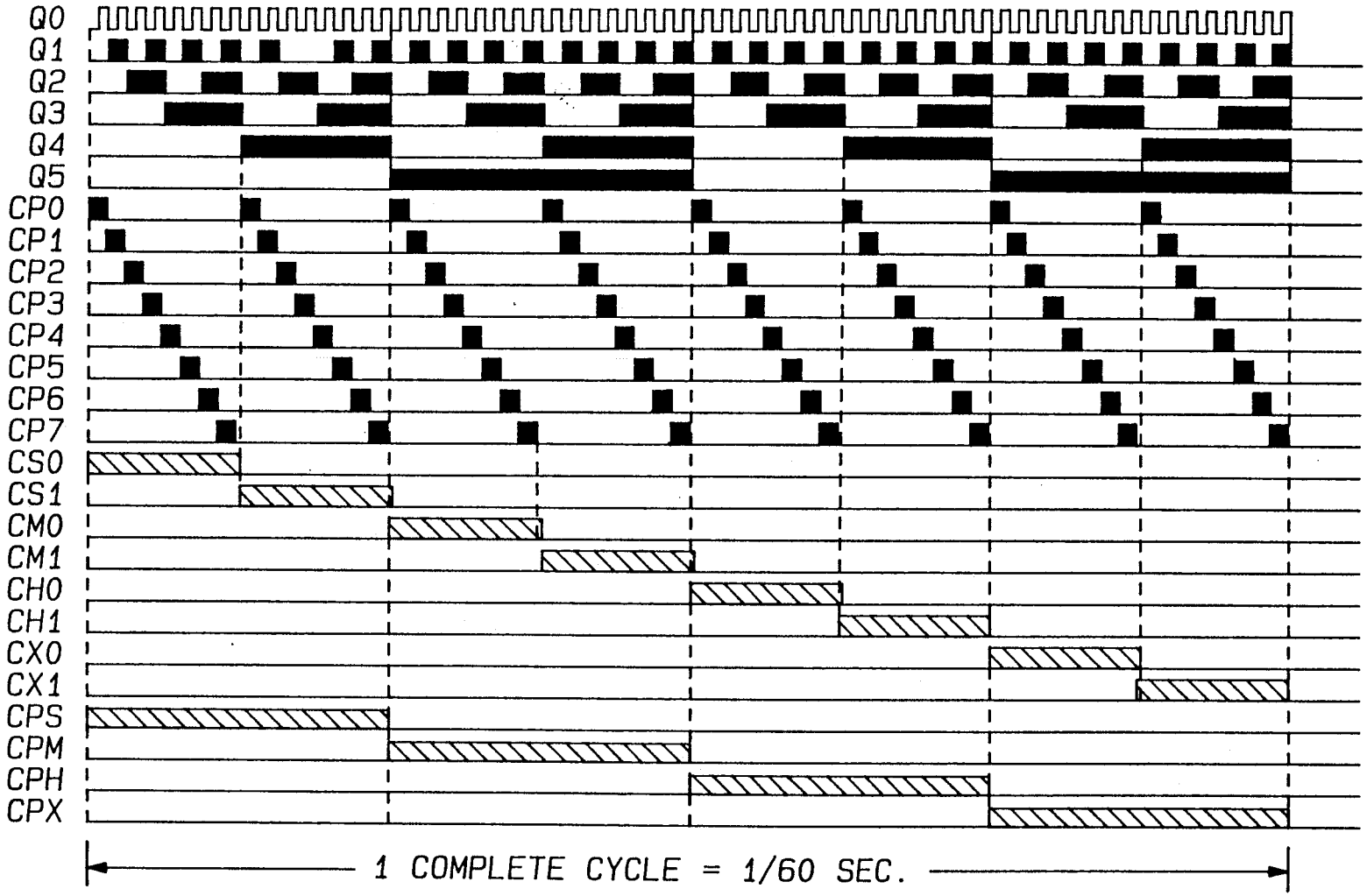
FIG. 6 is a diagram of the time interdependancies of the phase clocks.

FIG. 6 is a timing diagram showing the relationship of these phase clocks generated by the circuitry of FIG. 5. Each loop-cycle comprises 64 steps or phases. These are organized as eight groups of eight phases. Note that CPØ through CP7 occur once during the time frame designated CSØ, once during the frame designated CS1 and that CSØ and CS1 collectively define the seconds period (CPS) of the clock cycle.

Figure 7:
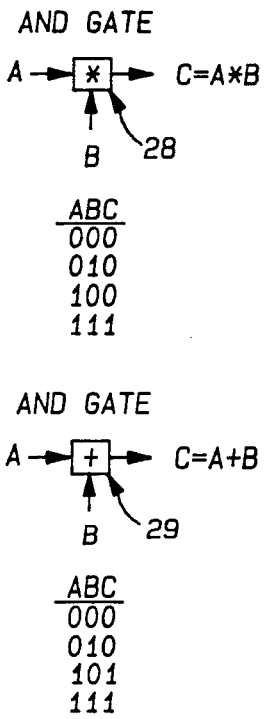
FIG. 7 is an explanation of the gate conventions used.
Figure 7:
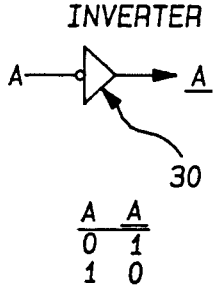

FIG. 7 shows the symbology conventions observed in the following dissertation. An AND-gate 28 shall be symbolized as a square box containing an asterisk (*). It shall have two inputs, "A" and "B". It shall have one output, "C". Associated with the symbol is a truth table. It should be noted that the output "C" is TRUE (logical 1) if and only if both inputs are TRUE (logical 1). In the text, the same asterisk shall be used, i.e. C=A*B. An OR-gate 29 shall be a box containing a plus symbol (+). Its output shall be TRUE if either input is TRUE and in the text shall be designated C=A+B. An inverter 30 shall be designated by a triangle with a zero (0) on its input. An inverter has the property that its output is the inverse of its input. i.e. if the input is high, its output is low (1>Ø) or if its input is low, its output is high (Ø>1). In text form if the name is underlined it shall be the inverse of the signal in its originally generated form. i.e. if SØ=1, SØ=Ø, conversly if SØ=Ø, SØ=1. The term "If CARRY" inplies "If the output of the CARRY latch is TRUE (Logical "1"). Also, a zero on an output line indicates that the TRUE condition is a low.

TIME KEEPING

Figure 8A:
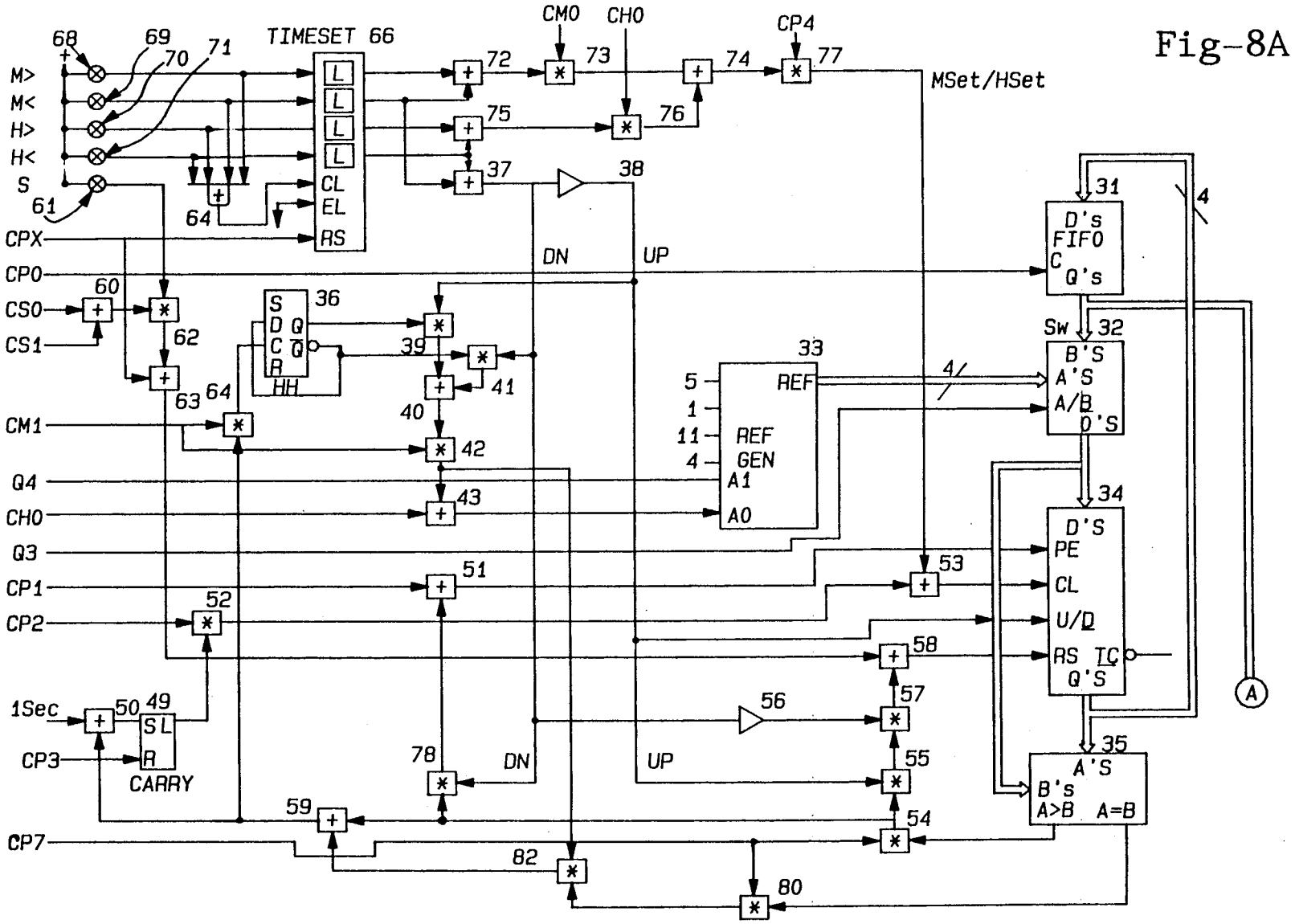
FIG. 8A, 8B are a block diagram of the timekeeping and display interface circuitry.
Figure 8B:
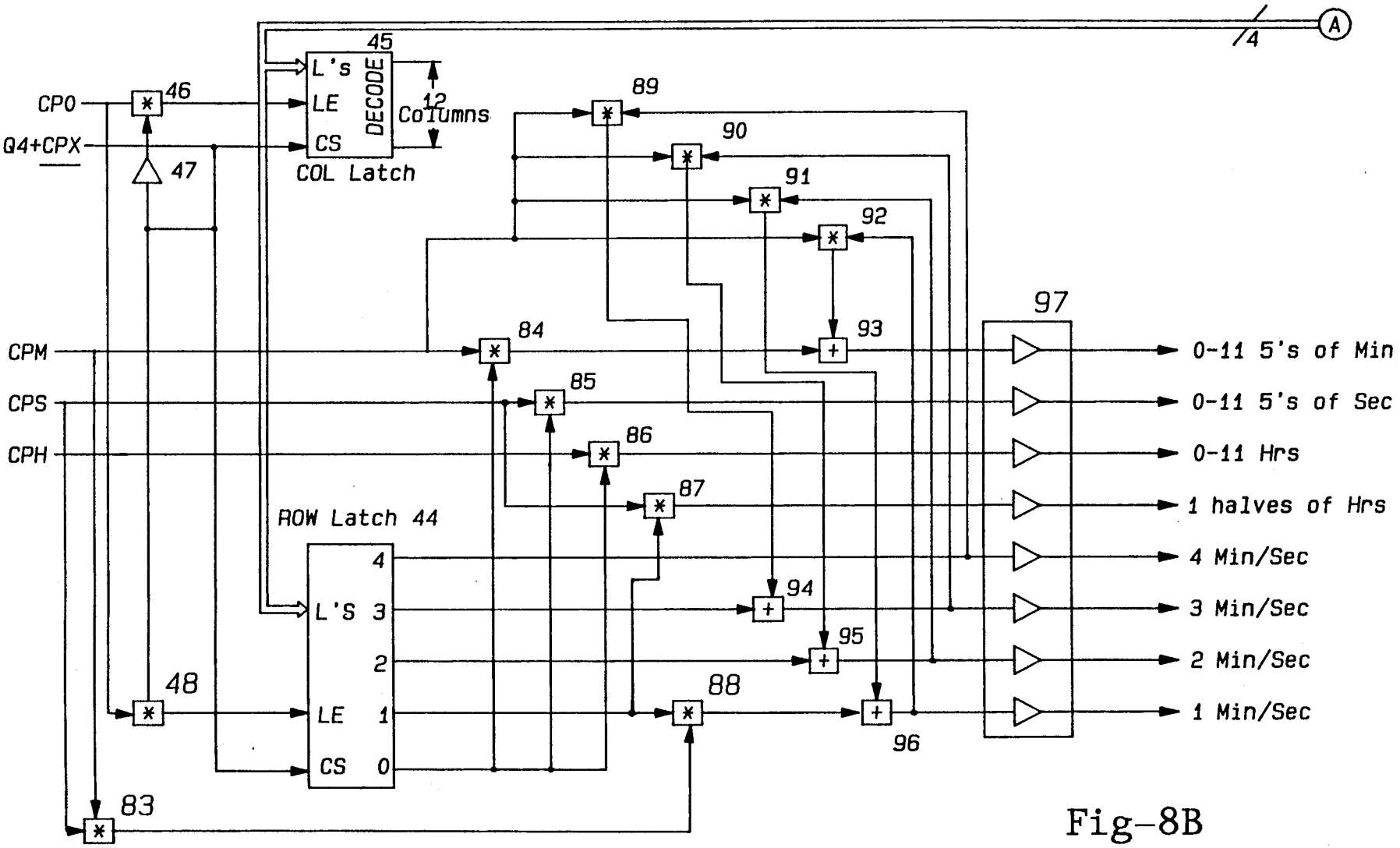

FIG. 8 shows the organization of the Timekeeping Mechanism 8. The heart of the mechanism is made up of a 4-bit wide by 8-bit long FIFO REGISTER 31, a 4-bit wide 2-way SWITCH 32, a 4/11/1/5 reference word selection matrix 33, a 4-bit COUNTER 34 with Up/-Down (U/D) Preset (PE) and Reset (RS) capability and with a Terminal Count (TC) output as well as QØ through Q3 output, and a 4-bit wide COMPARATOR 35 with "A"="B" and "A">"B" outputs.

It should be noted that, whereas a conventional digital clock counts to 12:59:59, i.e. Ø-1 10's-of-hours plus ØØ2 units-of-hours plus Ø-5 10's-of-minutes plus Ø-9 units-of-minutes plus 5 Ø-5 10's-of-seconds plus Ø-9 units-of-seconds, this clock counts to B1:B4:B4(where B is the hexadecimal notation for 11), i.e. Ø-B hours plus Ø-1 halves-of-hours plus Ø-B 5's-of-minutes plus Ø-4 units-of-minutes plus Ø-B 5's-of-seconds plus Ø-4 units-of-seconds.

The FIFO register 31 is thus organizated in order (a) the Ø to 4 seconds (rows Ø to 3) count, (b) the Ø to 11 5's-of-seconds count, (c) the Ø to 4 minutes count, (d) the Ø to 11 5's-of-minutes count, (e) the Ø to 1 half-hour count and (f) the Ø to 11 even hours count. Because of the binary organization of digital elements the register is 8 rather than 6 words long and two unused locations result.

| Address (Q6, Q5, Q4) | 4-bit Word |
|---|---|
| 000 | 0 to 4 seconds count |
| 001 | 0 to 11 5's-of-seconds count |
| 010 | 0 to 4 minutes count |
| 011 | 0 to 11 5's-of-minutes count |
| 100 | 0 to 1 halves-of-hours count |
| 101 | 0 to 11 Hours count |
| 110 | undefined |
| 111 | undefined |

The output of the COUNTER 34 is looped back to the input of the FIFO register 31. This loop is clocked through 60 cycles a second. During CPS the seconds counts are adjusted if required, during CPM, the minutes counts, and during CPH, the hours counts. During CPX activity is suppressed. Note also that the binary outputs Q3 and Q4 of 24 are used directly as well as being decoded. While Q3 is OFF (binary Ø), during clock phases CPØ to CP3, the FIFO output is present at the B-input to the 4-bit wide 2-way switch 32. When Q3 is ON (binary 1), the output from the reference generator 33 is present.

The REFERENCE GENERATOR 33 provides the required reference for the COUNTER 34 for each stage of counting. During CSØ the reference must be 4, during CS1, 11, during CMØ, 4, during CHØ, 1 and during CH1, 11. Reference to FIG. 6 will show that with the exception of CM1 and CHØ, output Q4 of the binary counter 24 (on FIG. 5) effectively defines the "4" and "11" reference requirements. That is if Q4 is LOW, "4" is selected, if Q4 is HIGH, "11" is selected. During CM1 the reference is a function of whether the counter is in an UP or DN (down) count mode and as to whether the count is less than 30 minutes or greater than 30 minutes. This is required to clock the ½'s-of-hours count properly. A HALF-HOUR latch (HH) 36 provides the required reference during CM1. The latch has two outputs Q and Q. The implication is that Q is always the opposite of Q, i.e. if Q is HIGH, Q is LOW. If Q is HIGH, Q is LOW. During the first half of each hour, Q is HIGH. This signal is designated HHØ. During the second half of each hour, Q is HIGH. This signal is designated HH1. The REFERENCE GENERATOR 33 with a 2-bit word address (A1, AØ) selects the reference word. Address ØØ="4", Ø1="1", 1Ø="11" and 11="5". Inspection will show that the high order address, A1, is equivalent to Q4. The low order address, AØ, is required to be HIGH when "1" or "5" desired.

The reference "1" is required during the half-hour clock period (CPØ). The reference "5" is required during CM1 if the minute count is less than 30-minutes and the counter is in a UP count mode, or if the minute count is more than 30-minutes and the counter is in a down count mode. (Note that the counter is always in an UP-count mode unless the operator has elected to set the time back, in which case the OR-gate 37 is HIGH. Thus:

AØ=(HHØ* UP (INVERTER 38 and AND-GATE 39)+(OR-GATE 40) HH1 * DN (AND-gate 41))* CM1 (AND-gate 42)+CHØ(OR-gate 43).

The clock has three separate types of cycles, a Display cycle, a Time Increment cycle, and a Time Set cycle. In fact every cycle is a display cycle while the time increment cycle is superimposed on it once per second and the set cycle when a set button is pressed. This superposition is accomplished by time-division multiplexing. The interface between the time keeping mechanism is provided by two decoding latches. A 3-bit to 8-line ROW latch 44 and a 4-bit to 16-line COLumn latch 45 (of which only the lowest 12 are used).

| Display Cycle functions always occur with CP0 as follows: | | |
|---|---|---|
| Q4 - Display 44, 45 OFF | CP0 | Clock the FIFO 31. (0–4 Sec) Load the Row Latch 44 (via AND-gate 46 and Inverter 47) |
| Q4 - Display 44, 45 ON (Displaying Seconds) | CP0 | Clock the FIFO 31. (0–11 5's Sec) Load the display Column Latch 45 (via AND-gate 48) |
| Q4 - Display 44, 45 OFF | CP0 | Clock the FIFO 31. (0–4 Min) Load the Row Latch 44 |
| Q4 - Display 44, 45 ON (Displaying Minutes) | CP0 | Clock the FIFO 31. (0–11 5's Min) Load the display Column Latch 45 |
| Q4 - Display 44, 45 OFF | CP0 | Clock the FIFO 27. (0–1½ Hrs) Load the Row Latch 44 |
| Q4 - Display 44, 45 ON (Displaying Hours) | CP0 | Clock the FIFO 27. (0–11 Hrs) Load the display Column Latch 45 |
| Q4 - Display 44, 45 OFF | CP0 | Clock the FIFO 27. (Unused) Load the Row Latch 44 |
| CPX - Display 44, 45 OFF (CPX is true only here) | CP0 | Clock the FIFO 27. (Unused) Load the display Column Latch 45 |

An Increment Cycle is superimposed on the Display Cycle by means of time-division multiplexing. An Increment Cycle is initiated by the occurance of a "1 Second Clock" (1 Sec) which sets the CARRY latch 49 (via OR-gate 50). This occurs on CPØ.

UNITS-OF-SECONDS INCREMENT (Q4 selects "4" as the Reference)

CPØ—Clock the FIFO 31 (superimposed with Display Cycle)

CP1—Preset COUNTER 33. (Via OR-gate 51.) Because Q3 is low during CP1, the current output of the FIFO 31 which is now the Units-of-Seconds count is loaded in the COUNTER 33 via the A/B SWITCH 32.

CP2—if CARRY 49 then Clock (the COUNTER 33) Clock=CP2*CARRY. (AND-gate 52 via OR-gate 53.)

CP3*(CPX)—Reset CARRY latch 49.

CP7—(Because Q3 is high during CP7, the reference is selected at this time by the A/B SWITCH 32) Note that this places the Reference at the "B" input of the COMPARATOR 35 while the COUNTER 34 output is at the "A" input. If the Count is greater than the Reference (C>R) and the COUNTER 34 is in an UP count mode (i.e. the output of Inverter 38 is high), then Reset COUNTER 34 (to Ø) and Set the CARRY latch 49. i.e. Reset COUNTER 34=(A>B) * CP7 AND-gate 54) * UP (AND-gate 55) * HHC (output of AND-gate 42 through Inverter 56)(AND-gate 57) via OR-gate 58. Also Set the CARRY latch 49 (via the OR-gates 50 and 59).

An exception to the above is that during the period CPS (i.e. CSØ+CS1 via OR-gate 60), if the SECONDS SET pushbuton 61 is pressed the COUNTER 34, via AND-gate 62, OR-gate 63 and OR-gate 60, is held in the Reset state (output set to Ø and counting inhibited).

5'S-OF-SECONDS INCREMENT (Q4 selects 11 as the Reference)

CPØ—Clock the FIFO 31.

CP1—Preset COUNTER. 34 Because Q3 is low during CP1, again, the current count of 5's-of-Seconds is loaded from the FIFO to the COUNTER 34 via the A/B SWITCH 33. (If it is not incremented it will be returned unchanged to the FIFO input).

CP2—If CARRY then Clock (the COUNTER 34)

CP3—Reset CARRY latch 49.

CP7—If the C>R then Reset COUNTER 34 (to Ø) and Set the CARRY latch

UNITS-OF-MINUTES INCREMENT (Q4 selects 4 as the Reference)

CPØ—Clock the FIFO 31.

CP1—Preset COUNTER 34. The current count of the Units-of-Minutes is loaded from the FIFO is loaded in the COUNTER 34

CP2—If CARRY then Clock (the COUNTER 34)

CP3—Reset CARRY latch 49.

CP7—If the C>R then Reset COUNTER 34 and Set the CARRY latch 49.

5'S OF MINUTES INCREMENT

When in the UP count mode and the minutes count goes from 29 minutes to 30 minutes (with this clock from 5 5's-of-minutes+4 1's-of-minutes to 6 5's-of-minutes+Ø 1's-of-minutes) the half-hour latch, HH 36, must be clocked but the COUNTER 34 must not be reset. This is accomplished by selecting 5 as the reference during the 5's-of-minutes set period (CM1) with HH low. If this reference of 5 is exceeded, then set the CARRY latch (to clock the Half-hour counter), but do not reset the 5's-of-minutes count. When this has been accomplished, the reference—since the clock is now in the second half-hour period—is now switched to 11 so that at the end of the hour the CARRY latch will be set and the COUNTER will be reset. Thus HH*UP selects 5 as the Reference, HH*UP selects 11 as the Reference.

CPØ—Clock the FIFO 31.

CP1—Preset COUNTER 34.

CP2—If CARRY then Clock (the COUNTER 34)

CP3—Reset CARRY latch 49.

CP7—CP7 * C>R (AND-gate 54)=Set the CARRY latch 49 (but because the output of inverter 56 is now low, AND-gate 57 inhibits the Reset of COUNTER 34. However with the output of AND-gate 42 HIGH (UP*CM1*HH) the HH latch 36 is clocked via AND-gate 64. During the second half-hour (UP*CM1*C>R*HH) since the output of AND-gate 42 is now LOW, while the CARRY latch 49 is now set as before (through OR-gates 59 and 50) and the HH latch 36 is clocked (via OR-gate 59 and AND-gate 64) AND-gate 57 is enabled and the COUNTER 34 is reset.

HALVES OF HOURS INCREMENT (Q6*Q4 selects 1 as the Reference)

CPØ—Clock the FIFO 31.

CP1—Preset COUNTER 34. Because Q3 is low during CP1, the current output of the FIFO is loaded. (If it is not incremented it will be returned unchanged to the FIFO input.)

CP2—If CARRY then Clock (the COUNTER 34)

CP3—Reset CARRY latch 49.

CP7—C>R=Reset COUNTER 34 and Set the CARRY latch 46.

HOURS INCREMENT (Q4 selects 11 as the Reference)

CPØ—Clock the FIFO 31.

CP1—Preset COUNTER 34.

CP2—If CARRY then Clock (the COUNTER 34)

CP3—Reset CARRY latch 49.

CP7—C>R=then Reset COUNTER 34 and Set the CARRY latch 49.

The COUNTER 34 is held in a Reset mode during the undefined period CPX (via OR-gate 63). The FIFO 31 is clocked however.

A Set Cycle is enabled if the clock is not in an increment cycle. Set functions occur only during CP4 and CP7 when the TIMESET latch 66 is set. The TIMESET latch is set via OR-gate 67 whenever one of; the Minute Increment (M>) pushbutton 68, the Minute Decrement (M<) pushbutton 69 the Hour Increment (H>) pushbutton 70 or the Hour Decrement (H<) pushbutton 71 is pressed.

If M<+H< then the COUNTER 34 is placed in a Down Count mode via OR-gate 37 and inverter 38. If either M> or M< is pressed (OR-gate 72) and the clock is in the units-of-minutes set phase (CMØ) (AND-gate 73) or (OR-gate 74) either H> or H< is pressed (OR-gate 75) and the clock is in the units-of-hours set phase (CHØ)(AND-gate 76), at CP4 (AND-gate 77) the COUNTER 34 will be clocked (via OR-gate 53). This will occur only if one of the Minute or Hour adjust latches in the TIMESET latch 66 is set. i.e.

If CP4 * Q4 * (CPM * (M>+M<)+(CPH * (H>+H<) then Clock the COUNTER 34.

Note that when the counter is clocked it may overflow, that is, exceed the allowable count of 4 (or 1) in the Up-Count mode or count from Ø to 15 in the Down-Count mode. If this happens in Up-Count mode, then, at CP7, the COUNTER 34 will be Reset via AND-gate 54 (at CP7), AND-gate 55 (in the Up-Count mode) AND-gate 57 (not at 29 to 30 minutes) via OR gate 58. Also at this time, the CARRY latch 49 will be set via OR-gates 50 and 59.

With the CARRY latch set, as in the time increment cycle, the count will overflow into the higher order registers. In the Down Count mode at CP7, the COUNTER 34 will be Preset via AND-gate 78 (in the Down count mode) via OR-gate 51 to the Reference value. Again, the CARRY-latch 49 will be set via OR-gates 50 and 59. It will also be set during CM1, if C=R (AND-gate 80 and AND-gate 82 via OR-gates 59 and 50). Since the TIMESET latch 66 is still set, the COUNTER 34 will remain in the down count mode and the next higher register will count down. At the end of one colmplete cycle, CPX resets the TIMESET latch 66.

DISPLAY INTERFACE CIRCUITRY

Figure 9:
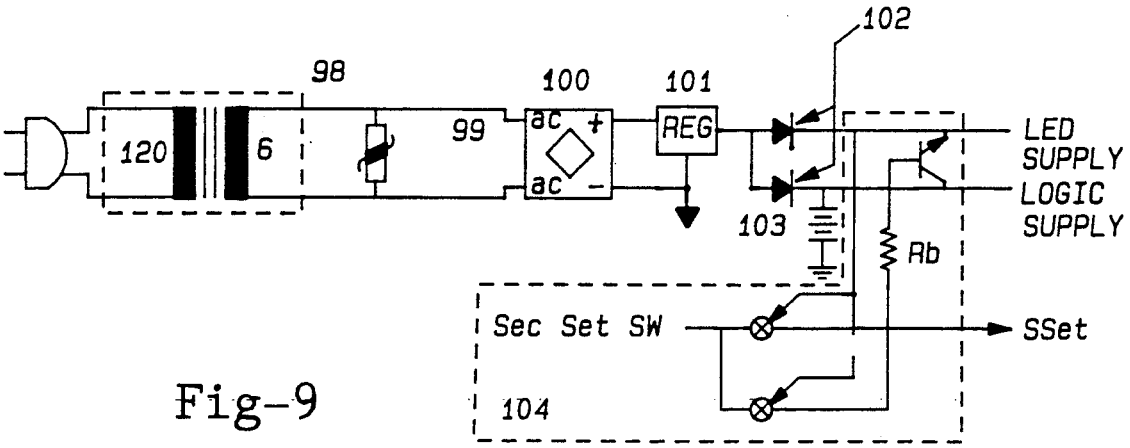
FIG. 9 is a block diagram of the power supply.

The Display Interface Circuitry 7 is also shown in FIG. 9 and provides the interface between the Time Keeping Circuitry 8 and the Display 6. The circuitry comprises the Column Latch/Decoder 45, the Row Latch/Decoder 44, a series of decode gates 84–96 and a ROW DRIVER 97. This circuitry is required to sort the signals so that the required LED's are lighted. The Row Latch 44 contains the count of the 0–4 Seconds, 0–4 Minutes, and 0–1 Half-hours. Inspection will show that the DECODE GATES 84–96 provide the following Selection.

Row 7=5's of Min=CPM*0Ø+CPM*01=CPM*02+CPM*03+-CPM*04

Row 6=5's of Sec=CPS*0Ø

Row 5=Hrs=CPH*0Ø

Row 4=½ Hrs=CPH*01

Row 3=4 Min or 4 Sec=CPS*04+CPM*04

Row 2=3 Min or 3 Sec=CPS*03+CPM*(04+03)

Row 1=2 Min or 2 Sec=CPS*02+CPM*(04+03+02)

Row Ø=1 Min or 1 Sec=CPS*01+CPM*(04+03+02+01)

The ROW DRIVER 97 provides inversion and the power handling capability to sink the LED currents.

POWER SUPPLY CIRCUITRY

The Power Supply Circuitry 10 is shown in FIG. 9 and includes an external TRANSFORMER 98 to interface with the 120 Volt mains power. A surge adsorber 99 protects the circuitry from line transients. A DIODE BRIDGE 100 in conjunction with a VOLTAGE REGULATOR 101 provide the DC power source for the circuits. This power is isolated via two diodes 102 into LED and Set Circuitry supply power and Clock Counting supply power. The Clock Counting supply is backed up via a Ni-Cd Battery 103 to provide timekeeping in the event of loss of mains power. A CONVERSION SWITCH 104 changes the function of the SET PUSHBUTTON 61 (FIG. 8) so that with power off, pressing this switch does not set the time but rather enables, while it is pressed, the LED's.

What is claimed is:

1. An electronic timepiece comprising:

a display having a center position and twelve columns, each of said twelve columns having at least five display elements extending in a radial direction from said center position, respective display elements of each of said twelve columns further defining at least five concentric rows, one row of at least said five rows defining a five minute hand row an other row of said plurality of rows being an hour hand row, each of said display elements selectively operable to produce a visual signal when energized, and means for selectively energizing display elements of said twelve columns, said means for energizing having a timebase and means for timekeeping, said means for timekeeping having means for sequentially radially energizing at least four display elements along a selected column of said twelve columns, whereby said at least four display elements are illuminated by said means for timekeeping such that the illumination of each display element denotes the passage of a unit of time being registered by said display.

2. The timepiece of claim 1, wherein said means for timekeeping further comprises means for selectively deenergizing display elements of said twelve columns.

3. The timepiece of claim 2, wherein said means for selectively deenergizing display elements simultaneously deenergizes all display elements by said means for sequentially energizing.

4. The timepiece of claim 2, wherein said means for selectively deenergizing display elements deenergizes each display element of time energized by said means for sequentially energizing after passage of said unit of time.

5. The timepiece of claim 1, wherein each display element of said twelve columns has means to increase the intensity of light emitted from a display element registering both the passing of a second and a minute of time is energized to display the passing of a second, which display element being energized to indicate the passing of a minute.

6. The timepiece of claim 1, wherein said unit of time comprises one minute.

7. The timepiece of claim 1, wherein said unit of time comprises one second.

8. The timepiece of claim 1, wherein each said display element comprises a light emitting diode.

9. The timepiece of claim 1, wherein each display element of said five-minute hand row and said hour hand row comprise a first color when energized.

10. The timepiece of claim 5, wherein at least four display elements of each of said twelve columns comprise a second color when energized.

11. The timepiece of claim 7, wherein one of said at least five rows now a five second hand row wherein the passage of five seconds of time is registered by sequentially energizing display elements of said row.

12. The timepiece of claim 1, wherein each column of said twelve columns comprises seven display elements and said at least five rows is seven rows.

13. The timepiece of claim 1, wherein said means for energizing comprises a FIFO register for directing the energizing of said display elements.

14. The timepiece of claim 1, further comprising a center display element disposed at said center point, said center display element being continuously energized.

15. The timepiece of claim 1, further comprising a translucent front panel mounted over said display whereby light from energized display elements may be viewed.

16. The timepiece of claim 1, further comprising a means for displaying the passing of half past the hour intervals, said means for displaying further comprising a group of twelve display elements each of said twelve display elements positioned between an adjacent pair of said twelve columns.

* * * * *

UNITED STATES PATENT AND TRADEMARK OFFICE

CERTIFICATE OF CORRECTION

PATENT NO. : 5,008,870

DATED : April 16, 1991

INVENTOR(S) : James R. Vessa

It is certified that error appears in the above-identified patent and that said Letters Patent is hereby corrected as shown below:

Column 1, line 63, delete "mains" and insert --main--.

Column 2, line 15, insert --Fig. 3a shows a conventional dial;

Fig. 3b shows the time displayed using 6 LED's;

Fig. 3c shows a view of the clock face;

Fig. 3d shows the layout of the display face showing all LED's.--

UNITED STATES PATENT AND TRADEMARK OFFICE

CERTIFICATE OF CORRECTION

PATENT NO. : 5,008,870

DATED : April 16, 1991

INVENTOR(S) : James R. Reese

It is certified that error appears in the above-identified patent and that said Letters Patent is hereby corrected as shown below:

Column 10, line 4, delete "colmplete" and insert --complete--.

Signed and Sealed this

Second Day of March, 1993

*Attest:*

*Attesting Officer*

STEPHEN G. KUNIN

*Acting Commissioner of Patents and Trademarks*